US009496108B2

(12) United States Patent
Kawamura

(10) Patent No.: US 9,496,108 B2
(45) Date of Patent: Nov. 15, 2016

(54) ELECTRONIC COMPONENT, CONNECTION STRUCTURE OF ELECTRONIC COMPONENT AND TERMINAL FITTING, AND ELECTRICAL JUNCTION BOX HAVING ELECTRONIC COMPONENT

(71) Applicant: Yazaki Corporation, Tokyo (JP)

(72) Inventor: Yukihiro Kawamura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/619,250

(22) Filed: Feb. 11, 2015

(65) Prior Publication Data

US 2015/0155121 A1 Jun. 4, 2015

Related U.S. Application Data

(63) Continuation of application No. PCT/JP2013/072137, filed on Aug. 20, 2013.

(30) Foreign Application Priority Data

Aug. 21, 2012 (JP) ..... 2012-182524

(51) Int. Cl.
*H01H 45/14* (2006.01)
*H01H 45/04* (2006.01)
(Continued)

(52) U.S. Cl.
CPC ..... *H01H 45/14* (2013.01); *H01H 45/04* (2013.01); *H01H 50/048* (2013.01); *H01H 2050/049* (2013.01); *H01R 13/405* (2013.01)

(58) Field of Classification Search
CPC ..... H01R 13/684; H01R 13/68; H01H 9/02; H01H 2009/0285; H01H 45/02; H01H 45/14
USPC ..... 257/696; 438/126, 127; 439/68–72
See application file for complete search history.

(56) References Cited

U.S. PATENT DOCUMENTS 4,437,718 A * 3/1984 Selinko ..... H05K 7/023 439/260
5,192,215 A * 3/1993 Grabbe ..... H05K 7/1023 439/525
5,606,298 A 2/1997 Weiser

FOREIGN PATENT DOCUMENTS

JP S63-146939 U 9/1988
JP 01-102826 A 4/1989
(Continued)

OTHER PUBLICATIONS

International Search Report mailed Oct. 8, 2013, issued for PCT/JP2013/072137.
(Continued)

*Primary Examiner* — Ross Gushi
(74) *Attorney, Agent, or Firm* — Locke Lord LLP

(57) ABSTRACT

Provided is an electronic component that can reduce housing space in the fitting direction of terminals and terminal fittings. A relay has a relay main body of which the outer shape is a rectangular solid, and a plurality of plate-shaped terminals that protrudes from the relay main body and that is fitted in the terminal fittings. The relay main body has a top surface and a bottom surface opposite the top surface, opposite lateral surfaces, and opposite lateral surfaces. The terminals of the relay are four terminals, with two protruding from the lateral surface and two protruding from the opposite lateral surface. Specifically, the terminals protrude from the lateral surfaces parallel to the fitting direction of the terminal fittings and the terminals in the relay main body. These terminals protrude from the lateral surfaces and bend perpendicularly toward the bottom surface.

4 Claims, 17 Drawing Sheets

(51) Int. Cl.
*H01H 50/04* (2006.01)
*H01R 13/405* (2006.01)

(56) References Cited

FOREIGN PATENT DOCUMENTS

| | | | |
|---|---|---|---|
| JP | 05-266773 | A | 10/1993 |
| JP | 08-031292 | A | 2/1996 |
| JP | 2002-133988 | A | 5/2002 |
| JP | 2010-221787 | A | 10/2010 |

OTHER PUBLICATIONS

The extended European search report dated Apr. 21, 2016 issued for corresponding European Patent Application No. 13830650.1.

* cited by examiner

ELECTRONIC COMPONENT, CONNECTION STRUCTURE OF ELECTRONIC COMPONENT AND TERMINAL FITTING, AND ELECTRICAL JUNCTION BOX HAVING ELECTRONIC COMPONENT

TECHNICAL FIELD

The present invention relates to an electronic component, a connection structure of the electronic component(s) with a terminal fitting (or terminal fittings), and an electrical junction box having the electronic component(s).

BACKGROUND ART

FIG. 21 of the accompanying drawings is a perspective view of a conventional relay. FIG. 22 is a perspective view of a connection structure of the relays shown in FIG. 21 with terminal fittings. FIG. 23 is a plan view of the connection structure of the relays with the terminal fittings shown in FIG. 22. FIG. 24 is a cross-sectional view taken along the line A-A in FIG. 23.

As shown in FIG. 21, the conventional relay 301 includes a relay main body 302 of which an outer shape is a rectangular solid (rectangular parallelepiped), and a plurality of plate-shaped terminals 303 that protrudes from a bottom face 302*b* of the relay main body 302. The plate-shaped terminals 303 are adapted to be fitted in terminal fittings 304 (shown in FIG. 24). In FIG. 21, reference numeral 302*a* designates a top face of the relay main body 302, and reference numerals 302*c*-302*f* designate lateral faces of the relay main body 302. The arrow K designates the fitting direction of the terminals 303 into the terminal fittings 304.

As shown in FIGS. 22-24, a conventional "connection structure 307 of the relays with the relay fittings" includes the two relays 301 shown in FIG. 21, a plurality of terminal fittings 304 that receives (engages with) the terminals 303 of the relays 301, and a holding member 306 to receive and hold the relays 301 and the terminal fittings 304. It should be noted that one of the two relays 301 is not shown in FIG. 23 to illustrate the holding member 360.

As shown in FIG. 24, the terminal fittings 304 have female connectors that engage with the terminals 303 of the associated relays 301. The terminal fittings 304 are connected to ends of electrical cords 305.

The holding member 306 is made from synthetic resin. As shown in FIG. 22, the holding member 306 has two relay-receiving portions 363. Each of the relay-receiving portions 363 has a placement face 360 on which the relay main body 302 is placed, a plurality of receiving rooms 361 formed below the placement face 360 to receive the terminals 303 and the terminal fittings 304, and lances 362 extending in the receiving rooms 361 respectively to support (abut to) the associated terminal fittings 304. In FIG. 22, reference numeral 364 designates a latch (lock) to lock the holding member on a casing of an electrical junction box or the like.

The above-described "connection structure 307 of the relays and the terminal fittings" is housed in, for example, a casing made from synthetic resin to provide an electrical junction box for an automobile (see Patent Literature 1 mentioned below).

LIST OF PRIOR ART REFERENCES

Patent Literatures

PATENT LITERATURE 1: Japanese Patent Application Laid-Open Publication No. 2010-221787

SUMMARY OF THE INVENTION

Problems to be Solved by the Invention

However, a structure such as the electrical junction box that has the above-described conventional relays 301 needs the housing space for at least the sum of the height h11 of the relay main body 302 and the height h12 of the holding member 306. Thus, the structure having the conventional relays suffers from a problem that the dimension in the height direction, i.e., the dimension in the fitting direction of the terminals 303 into the terminal fittings 304, becomes large. The height h12 of the holding member 306 is approximately between twice and three times the length of the terminal 303.

The above-mentioned problem is encountered in not only the structure having the relays 301, but also a structure that includes, for example, an electronic component having a plurality of terminals if the terminals protrude from a bottom face of the electric component main body having a rectangular parallelepiped shape.

Therefore, an object of the present invention is to provide an electronic component which needs smaller housing space in a fitting direction of the terminal(s) in a terminal fitting (or fittings), a connection structure of such electronic component(s) with the terminal fitting(s), and an electrical junction box having such electronic component(s).

Solution to Solve the Problems

In order to achieve the above-mentioned object, a first aspect of the present invention provides an electronic component that includes a component main body of which an outer shape is a rectangular parallelepiped, and a plurality of terminals configured to fit in terminal fittings, with front end portions (free end portions) of the terminals facing at least one of lateral faces of the component main body.

Preferably, the electronic component is directed to an electronic component, with the terminals protruding from the component main body and bending perpendicularly.

Preferably, the electronic component is directed to an electronic component, with the terminals protruding from at least one of those lateral faces which are parallel to a fitting direction of the terminals of the component main body into the terminal fittings, and bending perpendicularly.

Preferably, the electronic component is directed to an electronic component and further including a resin member configured to hold the terminals and be assembled with the component main body. The terminals bend perpendicularly in contact with the resin member or bend perpendicularly inside the resin member.

Preferably, the electronic component is directed to an electronic component, with the front end portions (free end portions) of the terminals facing at least two of the lateral faces of the component main body.

Preferably, directed is a connection structure of an electronic component (or components) and terminal fittings, that includes: an electronic component (or components); a plurality of terminal fittings configured to receive and engage with a plurality of terminals of the electronic component(s); and a holding member configured to house the electronic component(s) and the terminal fittings.

Preferably, directed is an electrical junction box that includes: an electronic component (or components); a plurality of terminal fittings configured to receive and engage with a plurality of terminals of the electronic component(s);

and a holding member configured to house the electronic component(s) and the terminal fittings.

Advantages of the Invention

According to the invention, the front end portions of the terminals face at least one of the lateral faces of the component main body, and therefore it is possible to provide the electronic component that can reduce the space for housing the terminals and the terminal fittings in the fitting direction.

According to the invention, the terminals protrude from the component main body and bend perpendicularly. It is, therefore, possible to provide the electronic component that can reduce the space for housing the terminals and the terminal fittings in the fitting direction.

According to the invention, the terminals protrude from those lateral faces of the component main body which are parallel to the fitting direction of the terminals into the terminal fittings in the component main body, and bend perpendicularly. It is, therefore, possible to provide the electronic component that can reduce the space for housing the terminals and the terminal fittings in the fitting direction.

According to the invention, the electronic component further includes the resin member to hold the terminals, and the resin member is assembled with the component main body. Also, the terminals contact the resin member and bend perpendicularly, or the terminals bend perpendicularly inside the resin member. It is, therefore, possible for the resin member to receive a force, which is applied on the terminals upon inserting the terminals into the terminal fittings. Accordingly, the deformation of the terminals is prevented.

According to the invention, the front end portions of the terminals face at least two of the lateral faces of the component main body. It is, therefore, possible to provide the electronic component that can reduce the space for housing the terminals and the terminal fittings in the fitting direction.

According to the invention, the connection structure of the electronic component(s) and terminal fittings includes the electronic component(s), a plurality of terminal fittings configured to receive and engage with the terminals of the electronic component(s), and a holding member configured to house the electronic component(s) and the terminal fittings. It is, therefore, possible to provide the connection structure of the electronic component(s) and terminal fittings that can reduce the space for housing the terminals of the electronic component(s) and the terminal fittings in the fitting direction.

According to the invention, the electrical junction box includes the electronic component(s), a plurality of terminal fittings configured to receive and engage with the terminals of the electronic component(s), and a holding member configured to house the electronic component(s) and the terminal fittings. Therefore, it is possible to provide the electrical junction box that can reduce the space for housing the terminals of the electronic component(s) and the terminal fittings in the fitting direction.

MODE FOR CARRYING OUT THE INVENTION

First Embodiment

An "electronic component," a "connection structure of electronic components and terminal fittings," and an "electrical junction box" according to a first embodiment of the present invention will be described with reference to FIGS. 1 to 5.

Figure 1:
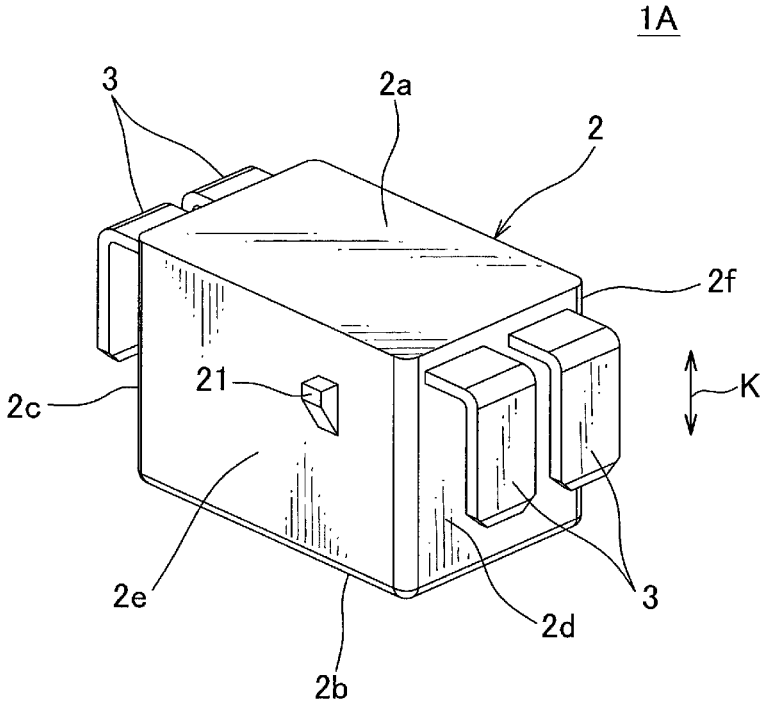
FIG. 1 is a perspective view of an electronic component according to a first embodiment of the present invention.

A relay ("electronic component" in the claims) 1A shown in FIG. 1 includes a relay main body ("component main body" in the claims) 2 having a rectangular parallelepiped contour, and a plurality of plate-shaped terminals 3 protruding from the relay main body 2. The terminals 3 are fitted in terminal fittings 4 (shown in FIG. 4).

The relay main body 2 has a top face 2*a* and a bottom face 2*b* opposite the top face 2*a*. The relay main body 2 also has opposite lateral faces 2*c* and 2*d*, and opposite lateral faces 2*e* and 2*f*. The top face 2*a*, the bottom face 2*b*, the lateral face 2*e* and the lateral face 2*f* are approximately rectangular planes. The lateral face 2*c* and the lateral face 2*d* are approximately square planes. The size of each of the lateral faces 2*c* and 2*d* is smaller than the size of each of the lateral faces 2*e* and 2*f*. On the lateral face 2*e*, there is provided a locking (latching) projection 21 to engage with (rest in) a holding member 6 (shown in FIG. 2).

The terminals 3 includes four terminals in this embodiment. Two of the four terminals 30 protrude from the lateral face 2*c*, and the other two protrude from the opposite lateral face 2*d*. Specifically, the terminals 3 protrude from the lateral faces 2*c* and 2*d* that are parallel to the fitting direction of the terminals 3 of the relay main body 2 into the terminal fittings 4. The arrow K indicates the fitting direction of the terminals 3 into the terminal fittings 4. The terminals 3 protrude from the lateral faces 2*c* and 2*d* and bend perpendicularly toward the bottom face 2*b*. The two terminals 3 protruding from the lateral face 2*c* are spaced from each other in a direction perpendicular to the direction of the arrow K. Likewise, the two terminals 3 protruding from the lateral face 2*d* are spaced from each other in a direction perpendicular to the direction of the arrow K.

Figure 2:
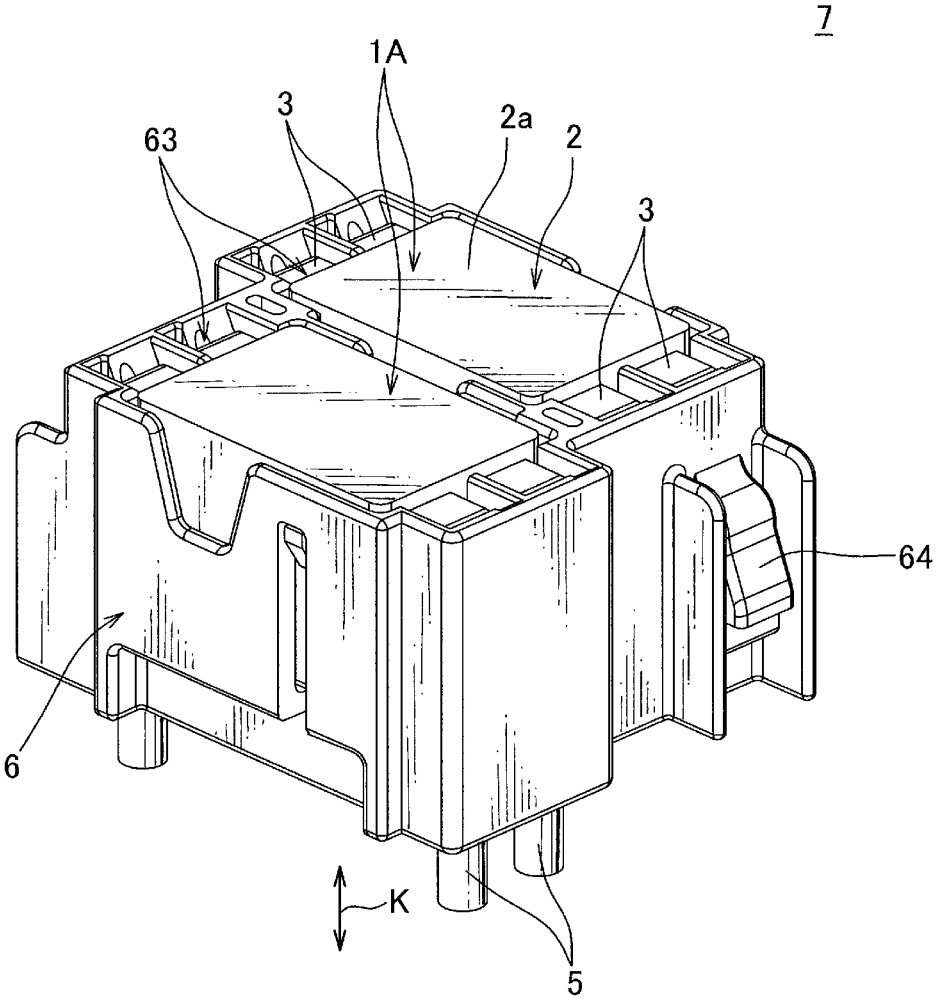
FIG. 2 is a perspective view of a connection structure of the electronic components of FIG. 1 with terminal fittings.
Figure 3:
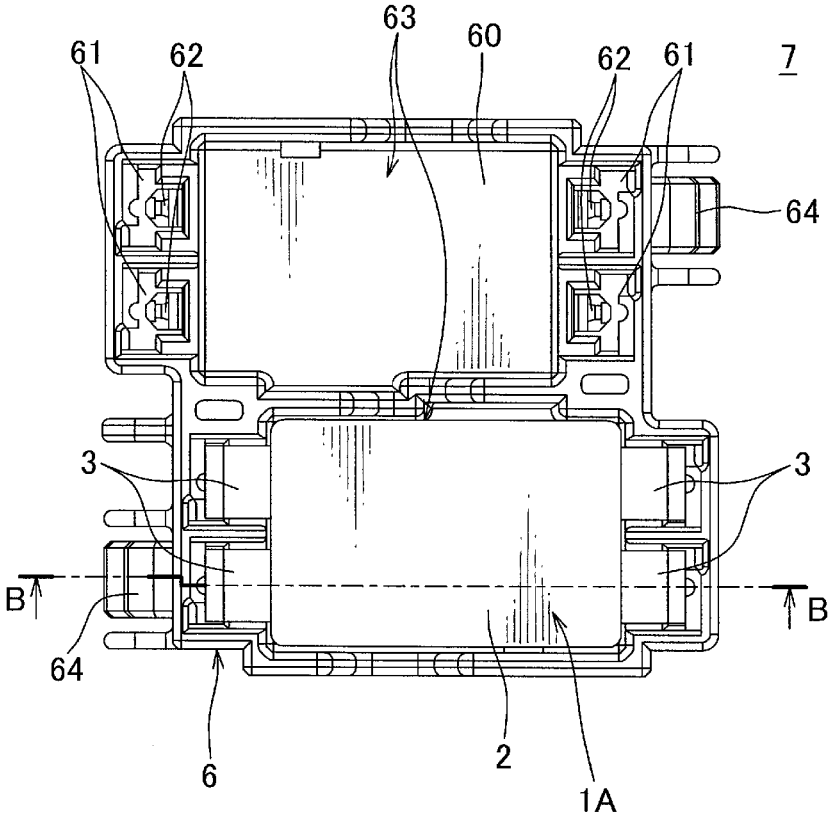
FIG. 3 is a plan view of the connection structure of the electronic components with the terminal fittings shown in FIG. 2.
Figure 4:
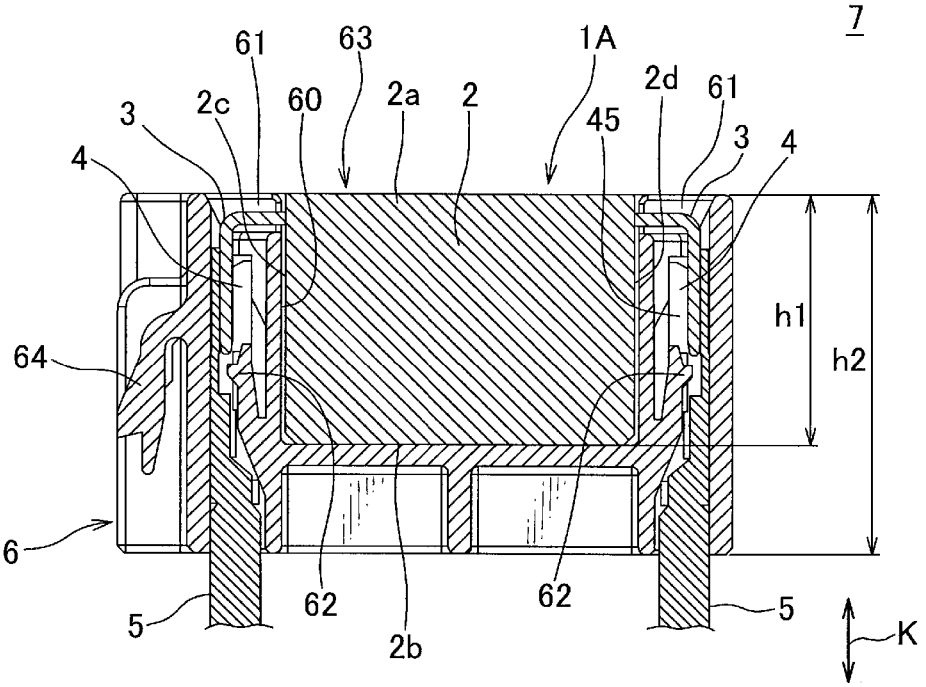
FIG. 4 is a cross-sectional view taken along the line B-B in FIG. 3.

The "connection structure 7 of the electronic components and the terminal fittings" shown in FIGS. 2-4 includes the relays 1A shown in FIG. 1, a plurality of terminal fittings 4 that engages with (receives) the terminals 3 of the relays 1A, and a holding member 6 to house the relays 1A and the terminal fittings 4. It should be noted that in FIG. 3 one of the two relays 1A is not shown for the sake of illustrating the holding member 6.

Figure 5:
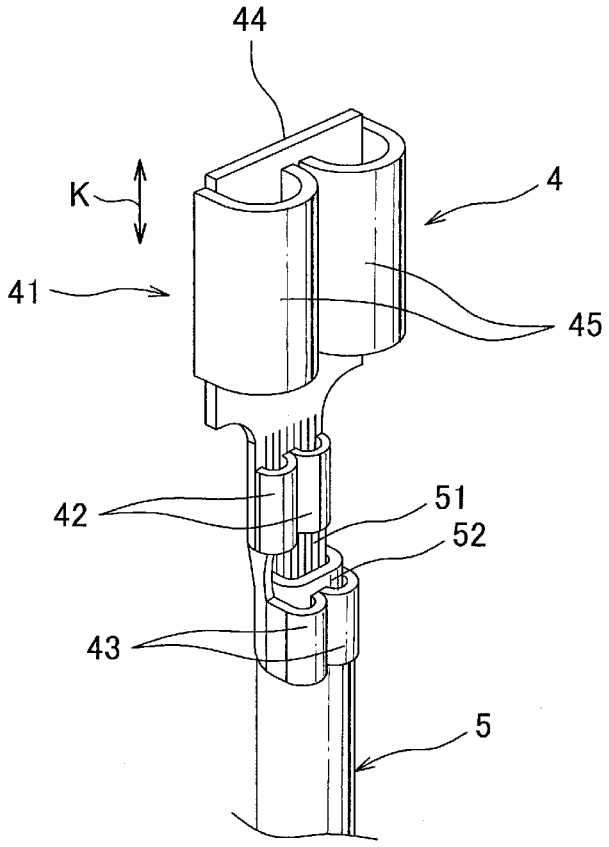
FIG. 5 is a perspective view of an electric cord that has the terminal fitting shown in FIG. 4.

As shown in FIG. 5, each of the terminal fittings 4 is prepared by press working (stamping) a metallic plate or the like, and is connected to a free end of an electric cord (cable) 5. The terminal fitting 4 has a female connection part (connector) 41 that engages with (receives) the terminals 3 of the relay 1A, a pair of crimping pieces 42 for fixedly clamping a core wire 51, which is exposed upon removal of an insulating coating 52 at the end of the electric cord 5, and another pair of crimping pieces 43 for fixedly clamping the insulating coating 52. The connection part 41 has a flat plate 44, and a pair of spring portions 45 standing from opposite ends (edges) of the flat plate 44 with free ends of the spring portions 45 bending toward the flat plate 44. The terminal fitting 4 having the above-described configuration catches the terminals 3 between the flat plate 44 and upper portions of the spring portions 45 to engage with the terminals 3.

The connection part 41 of the terminal fitting 4 is a "faston" type in this embodiment, but it should be noted that the shape of the connection part 41 of the present invention is not limited to the faston type. For example, the connection part 41 may have a cylinder (or cylinders) that can receive the terminals 3 and a bias spring (or bias springs) disposed in the cylinder(s). Alternatively, the connection part 41 may be shaped like a tuning fork that has a slot (or slots) to receive the terminals 3.

The holding member 6 is made from synthetic resin. As shown in FIGS. 2 and 3, the holding member 6 has two relay-receiving portions 63. As illustrated in FIG. 4, each of the relay-receiving portions 63 has a first receiving room 60 to receive the relay main body 2, second receiving rooms 61 to receive the terminals 3 and the terminal fittings 4, and lances 62 disposed in the respective second receiving rooms 61 to support (abut to) the respective terminal fittings 4. The second receiving rooms 61 are formed double on the both sides of the first receiving room 60. The upper face of the first receiving room 60 is open and the first receiving room 60 defines a concave shape. Each of the second receiving rooms 61 has a cylindrical shape having an upper opening and a lower opening. Each of the lances 62 extends from the inner wall of the second receiving room 61. The lance 62 abuts to the edges of the spring portions 45 of the associated terminal fitting 4 to support the terminal fitting 4. A hook (lock) 64 is provided on the outer face of the holding member 6 to engage with the casing of the electrical junction box or the like.

It should be noted that although the holding member 6 has the two relay-receiving portions 63 in this embodiment, the present invention is not limited the configuration having the two relay-receiving portions 63. For example, the holding member 6 may have only one relay-receiving portion 63, or the holding member may have three (or more) relay-receiving portions 63.

The assembling of the above-described "connection structure 7 of the electronic components and the terminal fittings" is carried out in the following manner. The terminal fitting 4 is connected to the end of the electric cord 5 in advance. The electric cords 5 having the terminal fittings are inserted in the second receiving rooms 61 from the bottoms of the second receiving rooms 61 such that the terminal fittings 4 hook on (rest on) the lances 62 respectively. Then, the relays 1A are inserted in the first receiving rooms 60 and the second receiving rooms 61 from the top of the holding member 6 such that the terminals 3 engage with the terminal fittings 4 respectively. The assembling of the connection structure is thus completed.

The electrical junction box includes the above-described "connection structure 7 of the electronic components and the terminal fittings" and a casing to house the holding member 6 of the "connection structure 7 of the electronic components and the terminal fittings." The casing is made from synthetic resin. The "electrical junction box" is disposed in an automobile, and used to send electricity and signals to electronic equipment in the automobile. In this specification, a junction block (junction box), a fuse block (fuse box) and a relay block (relay box) are collectively referred to as the electrical junction box.

It should be noted that the electrical junction box of this embodiment has the holding member 6 that is separate from the casing of the electrical junction box, but the present invention is not limited to such configuration. For example, the holding member 6 may be integral with the casing of the electrical junction box. In other words, the holding member 6 may be part of the casing of the electrical junction box.

As described above, the terminals 3 of the relay 1A of this embodiment protrude from the lateral faces 2*c* and 2*d* which are parallel to the fitting direction (arrow K) of the terminals 3 of the relay main body 2 into the terminal fittings 4, and bend perpendicularly toward the bottom face 2*b*. Therefore, the overall height (designated at h1 in FIG. 4) of the relay is the height of the relay main body 2. The overall height (designated at h2 in FIG. 4) of the holding member 6 of the "connection structure 7 of the electronic components and the terminal fittings" having such relays 1A is not equal to the sum of the height of the first receiving room 60 and the height of the second receiving room 61, but equal to the height of the second receiving room 61 only. Accordingly, it is possible to reduce the height of the space for housing the "connection structure 7 of the electronic components and the terminal fittings" (i.e., space for housing the holding member 6) in the electrical junction box. This reduces the overall height of the electrical junction box.

It should be noted that the present invention may be practiced in different embodiments. For example, the "connection structure of the electronic components and the terminal fittings" and the electrical junction box may include, instead of the relays 1A, relays 1B-1G as the "electronic components" which will be described in the second to seventh embodiments of the present invention.

Second Embodiment

Figure 6:
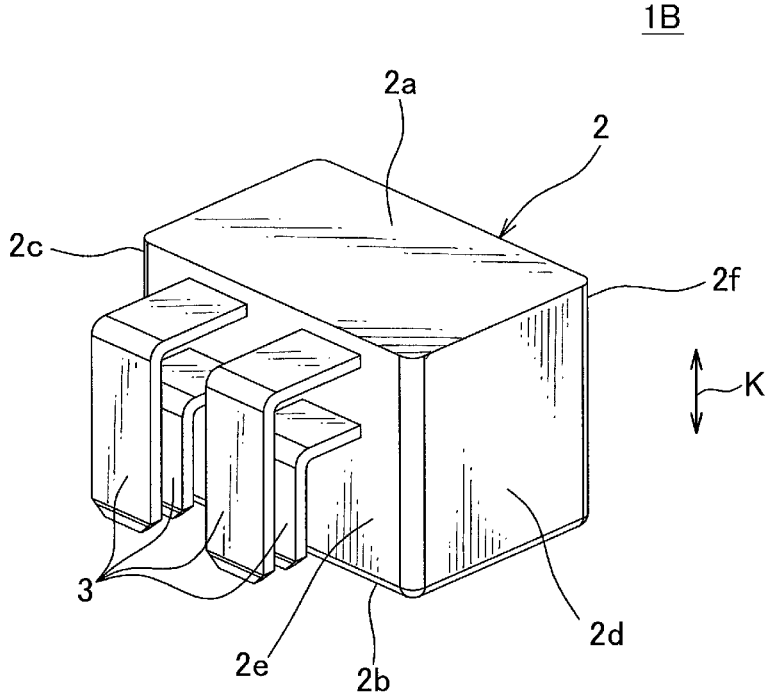
FIG. 6 illustrates a perspective view of an electronic component according to a second embodiment of the present invention.

A relay (i.e., "electronic component") of the second embodiment of the present invention will be described with reference to FIG. 6. In FIG. 6, those elements in the second embodiment which are the same as the first embodiment are assigned the same reference numerals and symbols as the first embodiment, and will not be described in the following.

The relay 1B shown in FIG. 6 has four terminals 3. All of the four terminals 3 protrude from the lateral face 2*e* of the relay main body 2, and bend perpendicularly toward the bottom face 2*b*. Two of the four terminals 3 protrude from an upper area of the lateral face 2*e* which are close to the top face 2*a*, and are spaced from each other in a direction perpendicular to the arrow K. The remaining two terminals 3 protrude from a lower area than the above-mentioned two terminals 3 protruding from the upper area close to the top face 2*a* (protrude from a lower area closer to the bottom face 2*b*), and are spaced from each other in a direction perpendicular to the arrow K. The free ends (front end) of the four terminals 3 extend to the same position in the direction of the arrow K.

Third Embodiment

Figure 7:
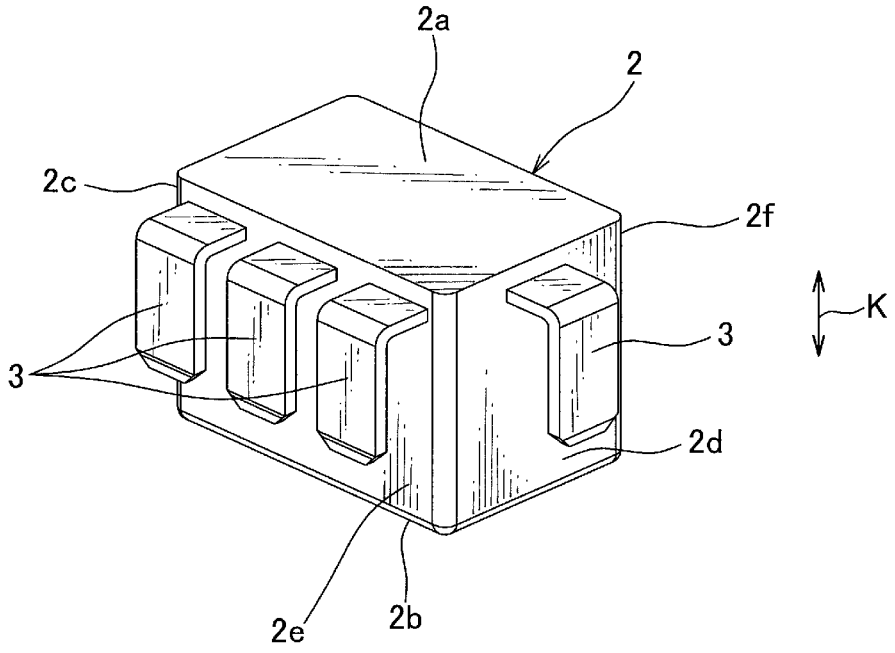
FIG. 7 illustrates a perspective view of an electronic component according to a third embodiment of the present invention.

A relay (i.e., "electronic component") of the third embodiment of the present invention will be described with reference to FIG. 7. In FIG. 7, those elements in the third embodiment which are the same as the first and second embodiments are assigned the same reference numerals and symbols as the first and second embodiments, and will not be described in the following.

The relay 1C shown in FIG. 7 has four terminals 3. Three of the four terminals 3 protrude from the lateral face 2*e* of the relay main body 2, and bend perpendicularly toward the bottom face 2*b*. The remaining terminal 3 protrudes from the lateral face 2*d* which is perpendicular to the lateral face 2*e*, and bends perpendicularly toward the bottom face 2*b*. The three terminals 3 protruding from the lateral face 2*e* are spaced from each other in a direction perpendicular to the arrow K, and arranged in a line along the direction perpendicular to the arrow K.

Fourth Embodiment

Figure 8:
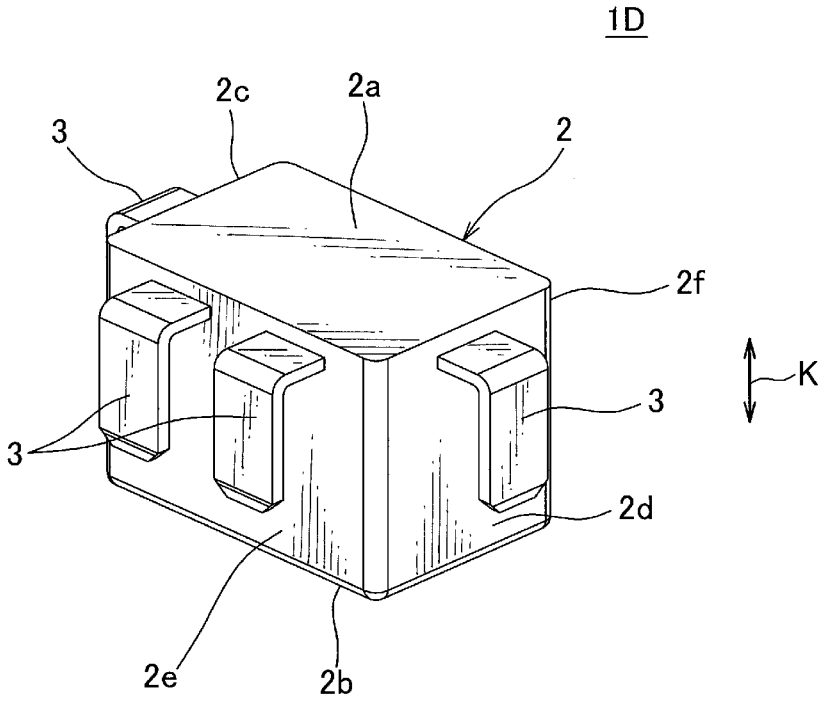
FIG. 8 illustrates a perspective view of an electronic component according to a fourth embodiment of the present invention.

A relay (i.e., "electronic component") of the fourth embodiment of the present invention will be described with reference to FIG. 8. In FIG. 8, those elements in the fourth embodiment which are the same as the first to third embodiments are assigned the same reference numerals and symbols as the first to third embodiments, and will not be described in the following.

The relay 1D shown in FIG. 8 has four terminals 3. Two of the four terminals 3 protrude from the lateral face 2*e* of the relay main body 2, and bend perpendicularly toward the bottom face 2*b*. One of the remaining two terminals 3 protrudes from the lateral face 2*c* which is perpendicular to the lateral face 2*e*, and bends perpendicularly toward the bottom face 2*b*, and the other terminal 3 protrudes from the lateral face 2*d* which is perpendicular to the lateral face 2*e* and bends perpendicularly toward the bottom face 2*b*. The two terminals 3 protruding from the lateral face 2*e* are spaced from each other in a direction perpendicular to the arrow K.

Fifth Embodiment

Figure 9:
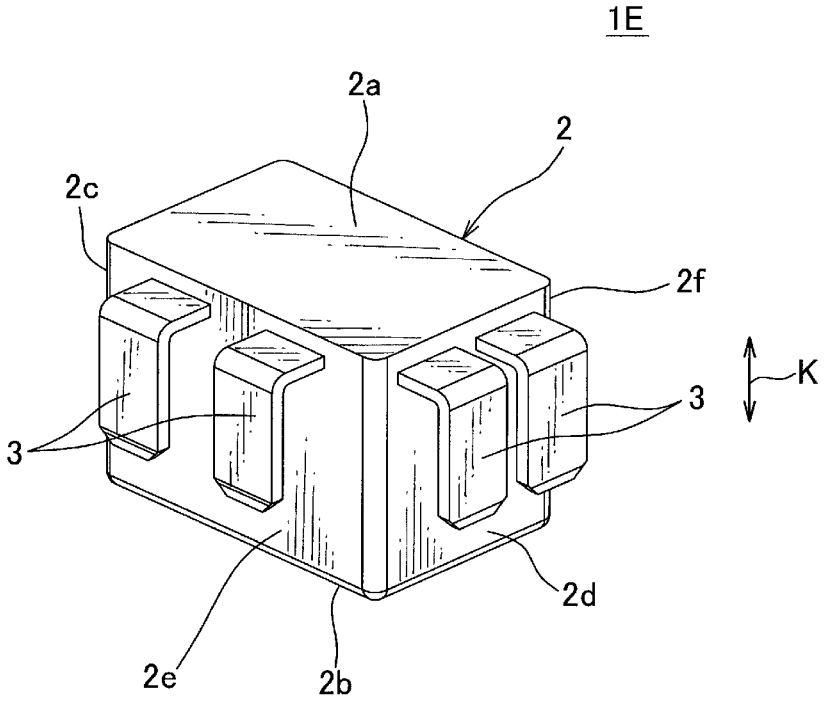
FIG. 9 illustrates a perspective view of an electronic component according to a fifth embodiment of the present invention.

A relay (i.e., "electronic component") of the fifth embodiment of the present invention will be described with reference to FIG. 9. In FIG. 9, those elements in the fifth embodiment which are the same as the first to fourth embodiments are assigned the same reference numerals and symbols as the first to fourth embodiments, and will not be described in the following.

The relay 1E shown in FIG. 9 has four terminals 3. Two of the four terminals 3 protrude from the lateral face 2*e* of the relay main body 2, and bend perpendicularly toward the bottom face 2*b*. The remaining two terminals 3 protrude from the lateral face 2*d* which is perpendicular to the lateral face 2*e*, and bend perpendicularly toward the bottom face 2*b*. The two terminals 3 protruding from the lateral face 2*e* are spaced from each other in a direction perpendicular to the arrow K. Likewise, the two terminals 3 protruding from the lateral face 2*d* are spaced from each other in a direction perpendicular to the arrow K.

Sixth Embodiment

Figure 10:
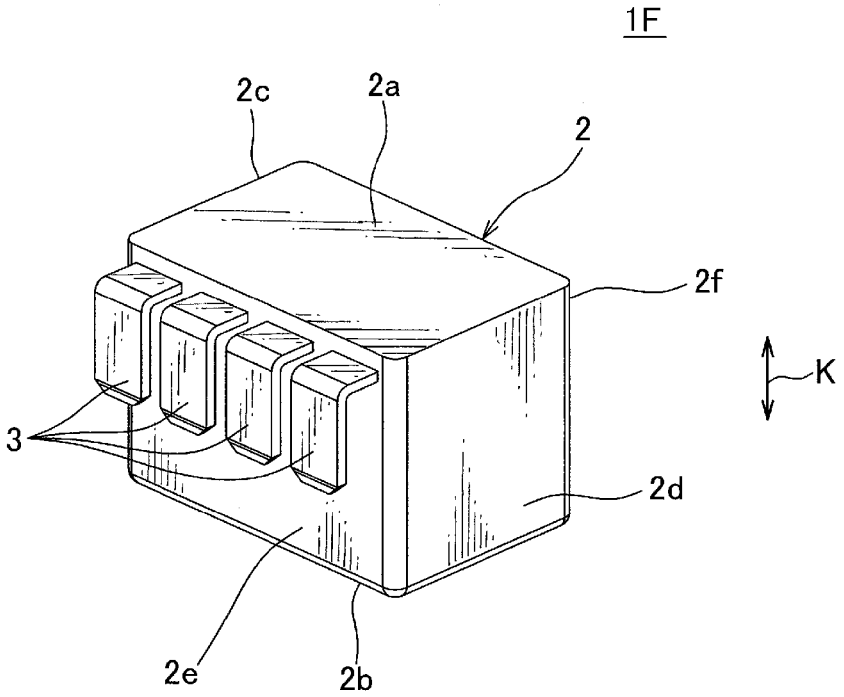
FIG. 10 illustrates a perspective view of an electronic component according to a sixth embodiment of the present invention.

A relay (i.e., "electronic component") of the sixth embodiment of the present invention will be described with reference to FIG. 10. In FIG. 10, those elements in the sixth embodiment which are the same as the first to fifth embodiments are assigned the same reference numerals and symbols as the first to fifth embodiments, and will not be described in the following.

The relay 1F shown in FIG. 10 has four terminals 3. All of the four terminals 3 protrude from the lateral face 2*e* of the relay main body 2, and bend perpendicularly toward the bottom face 2*b*. The four terminals 3 are spaced from each other in a direction perpendicular to the arrow K, and are linearly arranged in the direction perpendicular to the arrow K.

Seventh Embodiment

Figure 11:
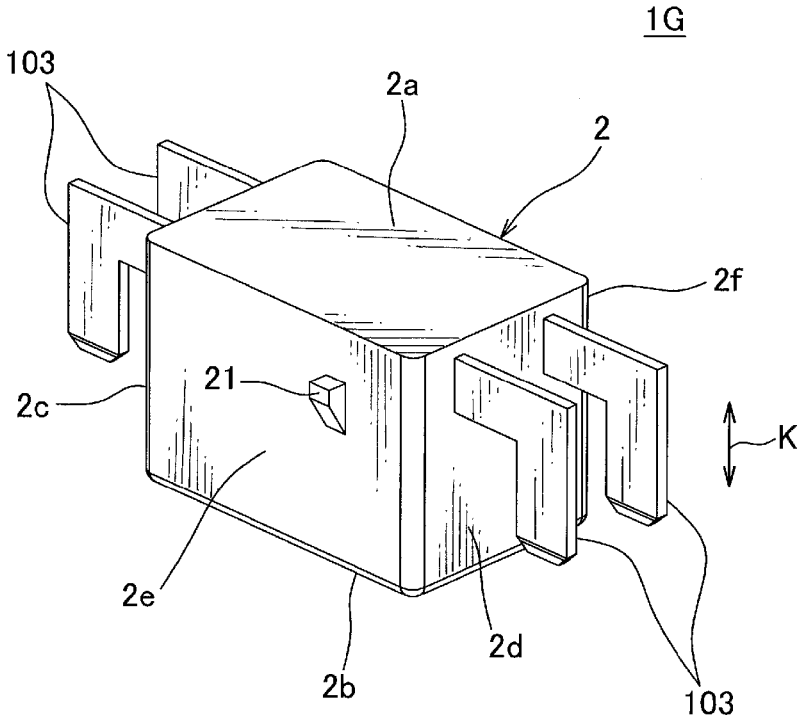
FIG. 11 illustrates a perspective view of an electronic component according to a seventh embodiment of the present invention.

A relay (i.e., "electronic component") of the seventh embodiment of the present invention will be described with reference to FIG. 11. In FIG. 11, those elements in the seventh embodiment which are the same as the first to sixth embodiments are assigned the same reference numerals and symbols as the first to sixth embodiments, and will not be described in the following.

The relay 1G shown in FIG. 11 has four terminals 103. Two of the four terminals 103 protrude from the lateral face 2*c* of the relay main body 2, and bend perpendicularly toward the bottom face 2*b*. The remaining two terminals 103 protrude from the opposite lateral face 2*d* of the relay main body 2, and bend perpendicularly toward the bottom face 2*b*. Although the terminals 3 of the above-described relays 1A-1F have the right-angle bending shape by a bending process, the terminals 103 of the relay 1G of this embodiment have the right-angle bending shape by a punching process applied to a flat metal plate (sheet metal). An L-shaped metal piece is obtained from the flat metal plate by the punching process. The two terminals 103 protruding from the lateral face 2*c* are spaced from each other in a direction perpendicular to the arrow K. Likewise, the two terminals 103 protruding from the lateral face 2*d* are spaced from each other in a direction perpendicular to the arrow K.

Eighth Embodiment

An "electronic component," a "connection structure of the electronic components and the terminal fittings" and an "electrical junction box" according to the eighth embodiment of the present invention will be described with reference to FIGS. 12-20. In FIGS. 12-20, those elements in the eighth embodiment which are the same as the first to seventh embodiments are assigned the same reference numerals and symbols as the first to seventh embodiments, and will not be described in the following.

Figure 12:
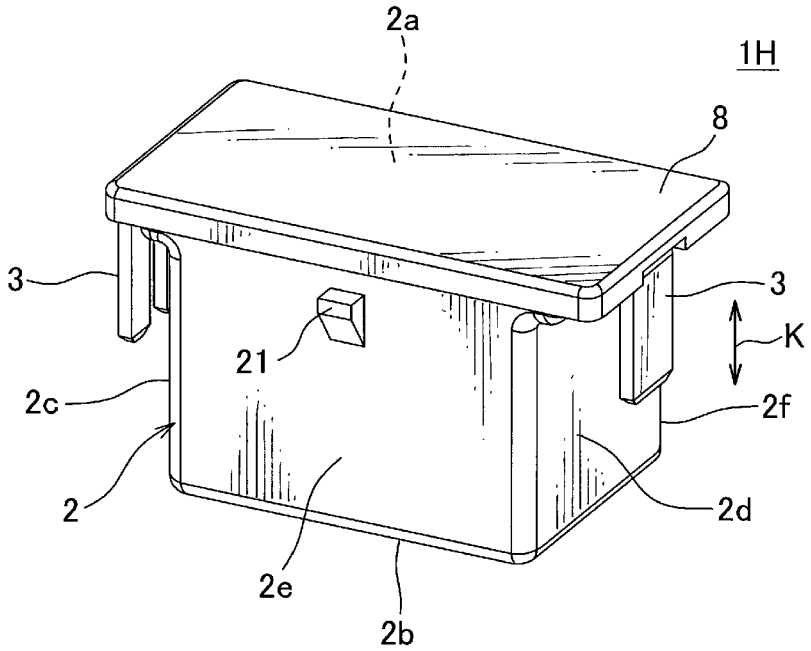
FIG. 12 illustrates a perspective view of an electronic component according to an eighth embodiment of the present invention.
Figure 13:
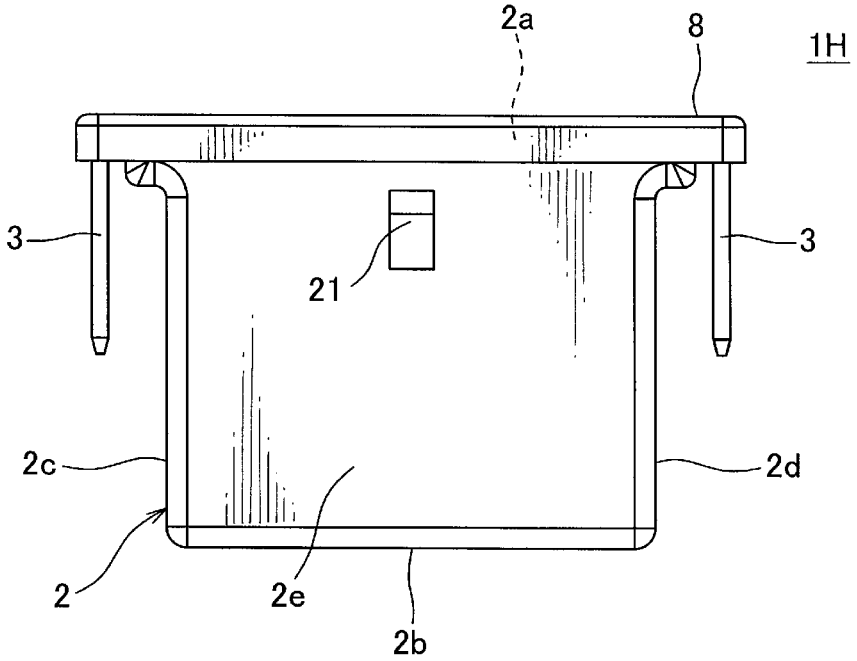
FIG. 13 is a front view of the electronic component shown in FIG. 12.
Figure 14:
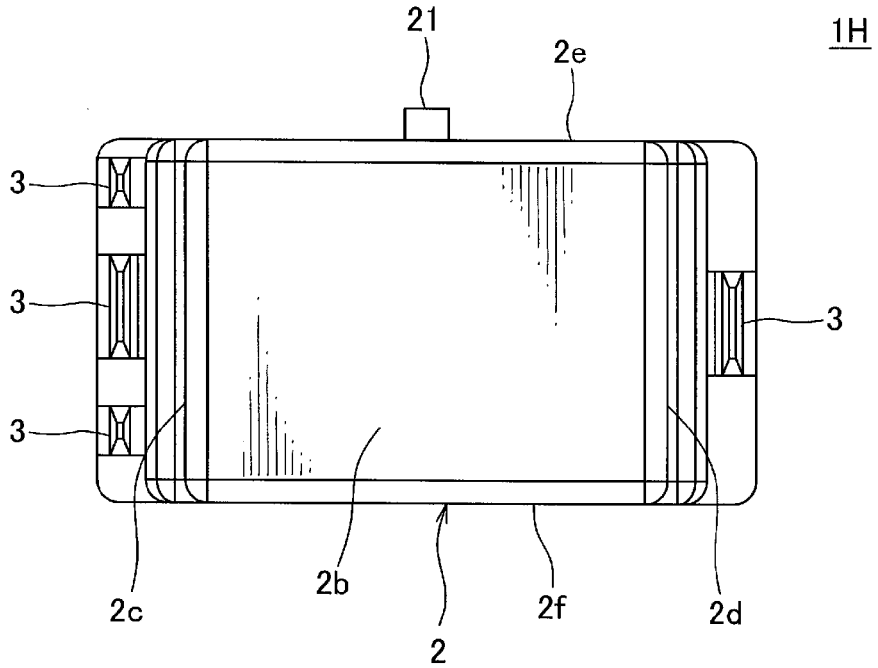
FIG. 14 is a bottom view of the electronic component shown in FIG. 12.

The relay ("electronic component" in the claim) 1H shown in FIGS. 12-14 includes a relay main body ("component main body" in the claim) 2, a plurality of terminals 3 protruding the relay main body 2, and a plate-like resin member 8 configured to hold (support) the terminals 3. The resin member 8 is attached to the top face 2*a* of the relay main body 2. The resin member 8 holds (supports) the terminals 3 by means of insert molding or a locking structure.

The terminals 3 are made from a metal plate, and held by the resin member 8 as mentioned above. Base portions of the terminals 3 are electrically coupled to a conductor (or conductors) in the relay main body 2. Each of the terminals 3 extends in contact with that plane of the resin member 8 which faces the relay main body 2 to a certain extent, and then bends perpendicularly toward the bottom face 2*b* of the relay main body 2. Free end portions (front end portions) of the terminals 3 (distal parts of the terminals 3) face the lateral faces 2*c* and 2*d* of the relay main body 2, respectively. The front end portions of the terminals 3 engage with connectors (connection portions) 141 of the terminal fittings 104 to be described later. The front end portions of the terminals 3 reach a position closer to the top face 2*a* of the relay main body 2 than the bottom face 2*b*. The relay 1H has four terminals 3. Three of the four terminals 3 face the lateral face 2*c*, and the remaining terminal 3 faces the lateral face 2*d*.

Figure 15:
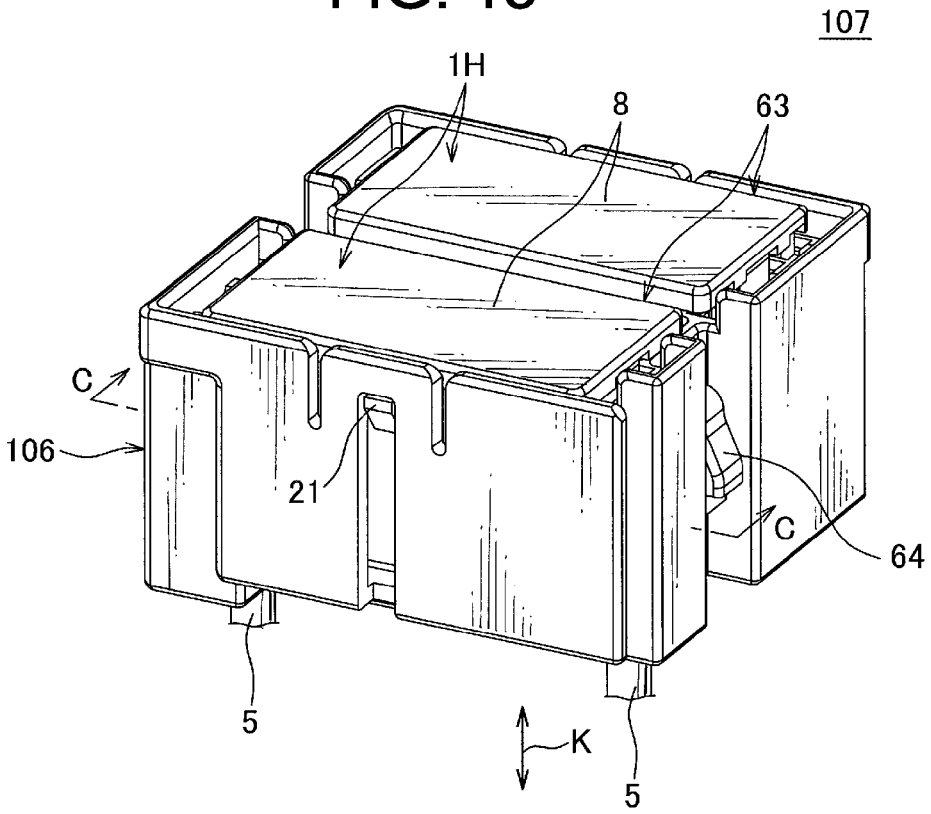
FIG. 15 is a perspective view of a connection structure of the electronic components shown in FIG. 12 with the terminal fittings.
Figure 16:
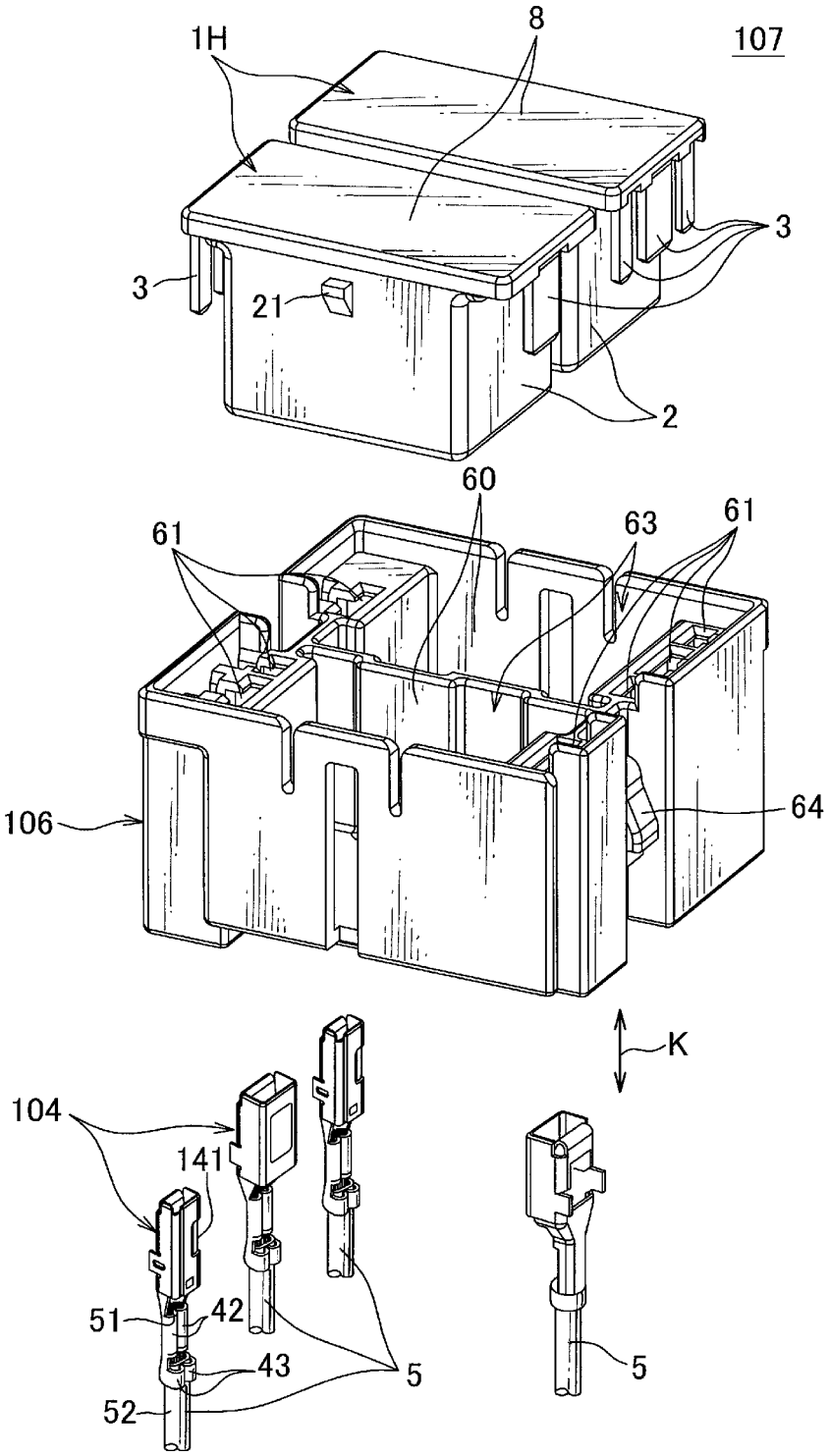
FIG. 16 is an exploded view of a connection structure of the electronic components shown in FIG. 15 with the terminal fittings.
Figure 17:
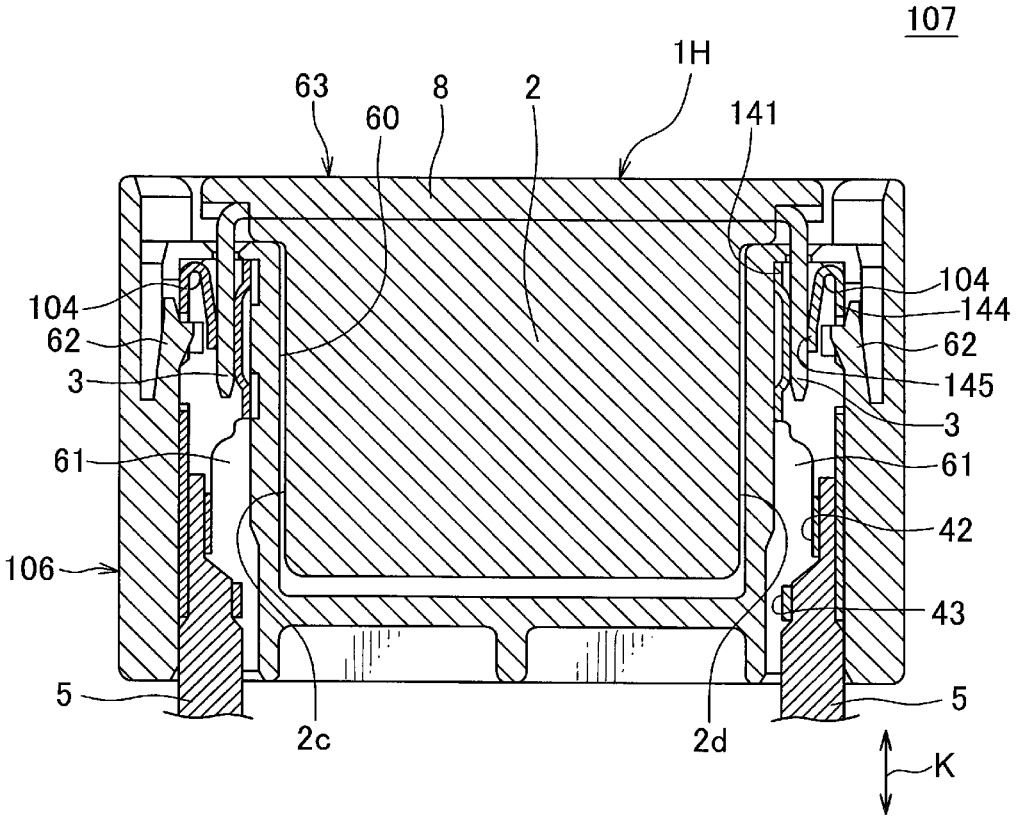
FIG. 17 shows a cross-sectional view taken along the line C-C in FIG. 15.

The "connection structure 107 of the electronic components and the terminal fittings" shown in FIGS. 15-17 includes the relays 1H shown in FIGS. 12-14, a plurality of terminal fittings 104 that receives and engages with the terminals 3 of the relays 1H, and a holding member 106 that houses the relays 1H and the terminal fittings 104.

Each of the terminal fittings 104 is obtained by applying a press working process to a metal plate, and is connected to the end of the associated electric cord 5. As illustrated in FIG. 16, the terminal fitting 104 has a female connection part 141 that engages with the associated terminal 3, a pair of crimping pieces 42 for fixedly clamping a core wire 51, which is exposed upon removal of an insulating coating 52 at the end of the electric cord 5, and another pair of crimping pieces 43 for fixedly clamping the insulating coating 52. As shown in FIG. 17, the connection part 141 has a cylinder 144 that receives and positions the terminal 3, and a spring 145 for biasing the terminal 3, which is positioned in the cylinder 144, on the inner wall of the cylinder 144.

Figure 18:
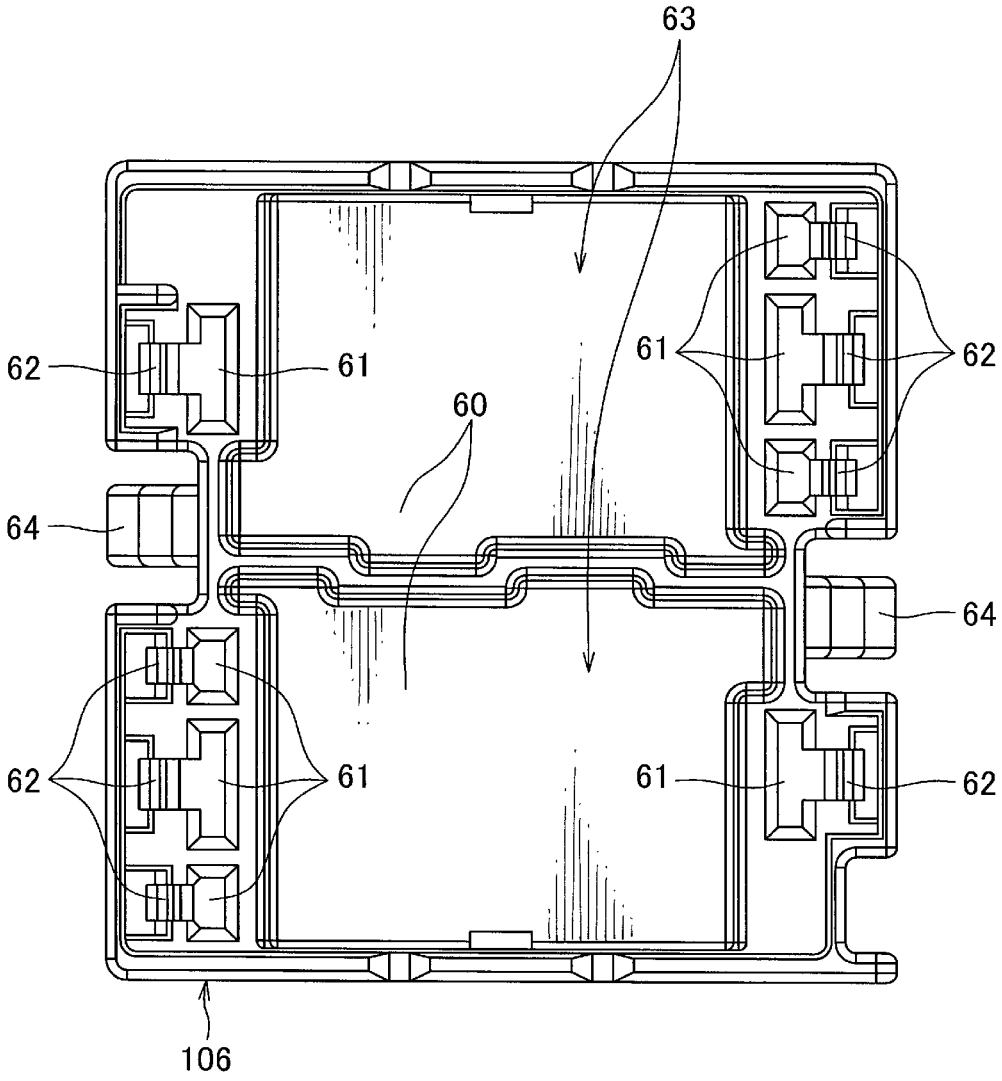
FIG. 18 shows a plan view of a holding member shown in FIG. 16.

The holding member 106 is made from synthetic resin. The holding member 106 has two relay-receiving portions 63, and a lock 64 to lock the holding member onto a casing of the electrical junction box or the like. As illustrated in FIGS. 16-18, each of the relay-receiving portions 63 has a first receiving room 60 to receive the relay main body 2, second receiving rooms 61 to receive the front end portions of the terminals 3 and the terminal fittings 104, and lances 62 disposed in the respective second receiving rooms 61 to support (abut to) the respective terminal fittings 104.

The resin member 8 of the above-described "connection structure 107 of the electronic components and the terminal fittings" can receive a force, which is applied on the terminals 3 upon inserting the terminals 3 into the terminal fittings 104. According, the deformation of the terminals 3 is prevented.

Although the terminals 3 contact the resin member 8 and bend perpendicularly in this embodiment, the present invention is not limited to such configuration. For example, the terminals 3 may bend perpendicularly inside the resin member 8.

Figure 19:
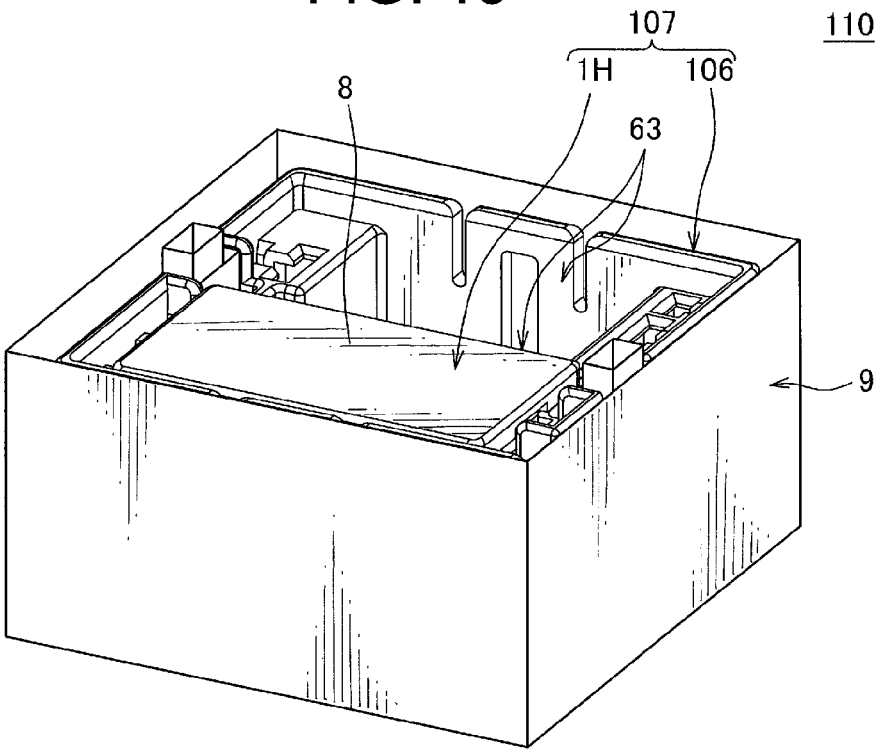
FIG. 19 shows a perspective view of the connection structure of the electronic components with the terminal fittings shown in FIG. 15 when the connection structure is received in a casing of the electrical junction box.

The electrical junction box 110 shown in FIG. 19 includes the above-described "connection structure 107 of the electronic components and the terminal fittings" and a casing 9 to house the holding member 106 of the "connection structure 107 of the electronic components and the terminal fittings." The casing 9 is made from synthetic resin. In FIG. 19, one of the two relays 1H is not shown.

Figure 20:
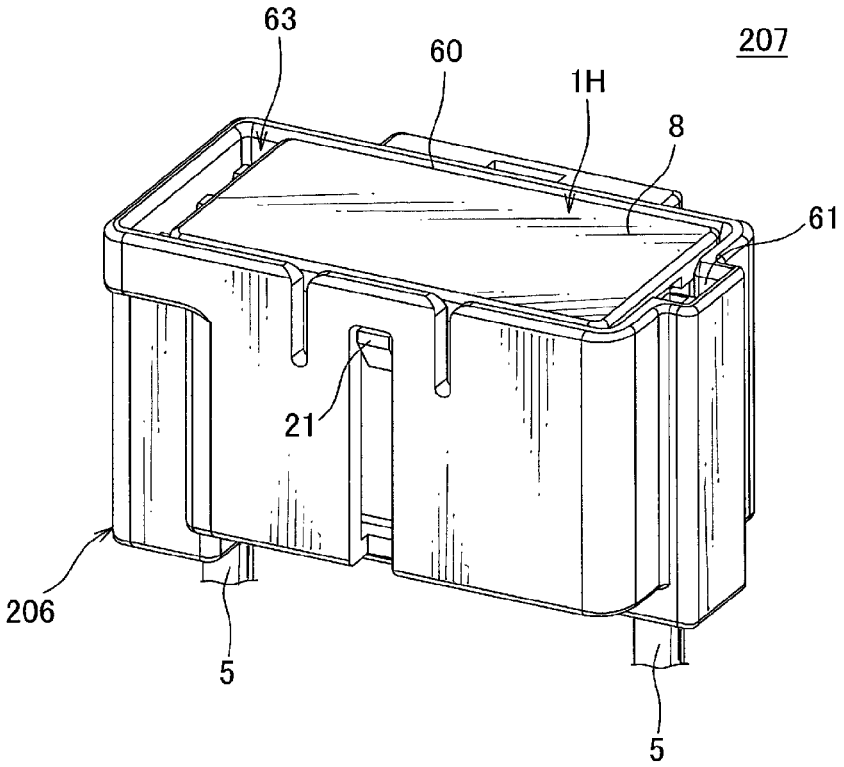
FIG. 20 shows a perspective view of another connection structure of the electronic components shown in FIG. 12 with the terminal fittings.
Figure 21:
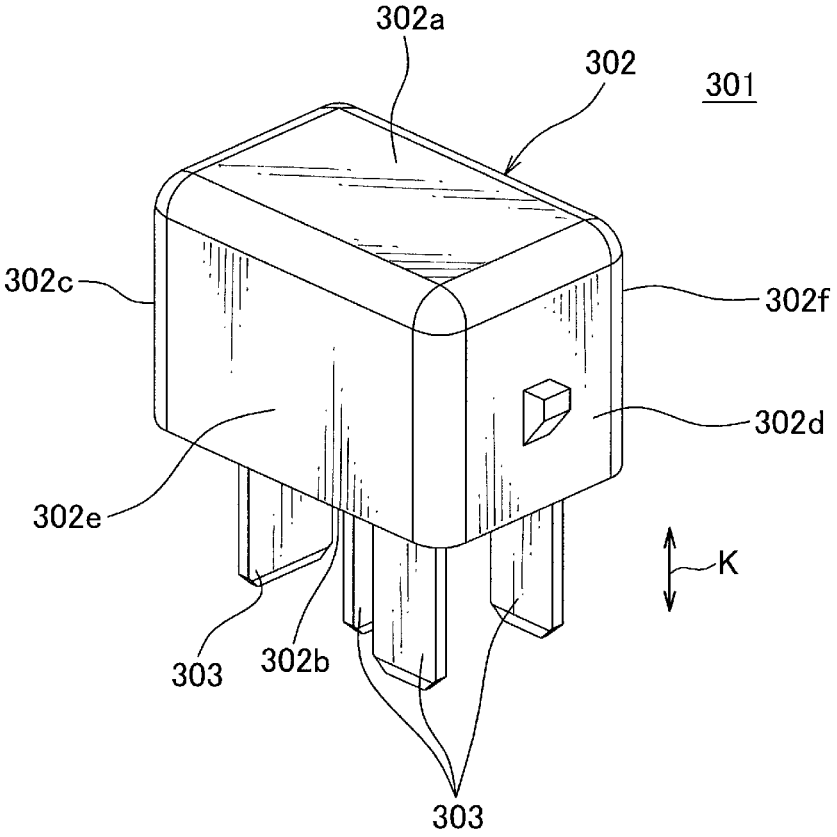
FIG. 21 PRIOR ART
FIG. 21 shows a perspective view of a conventional relay.
Figure 22:
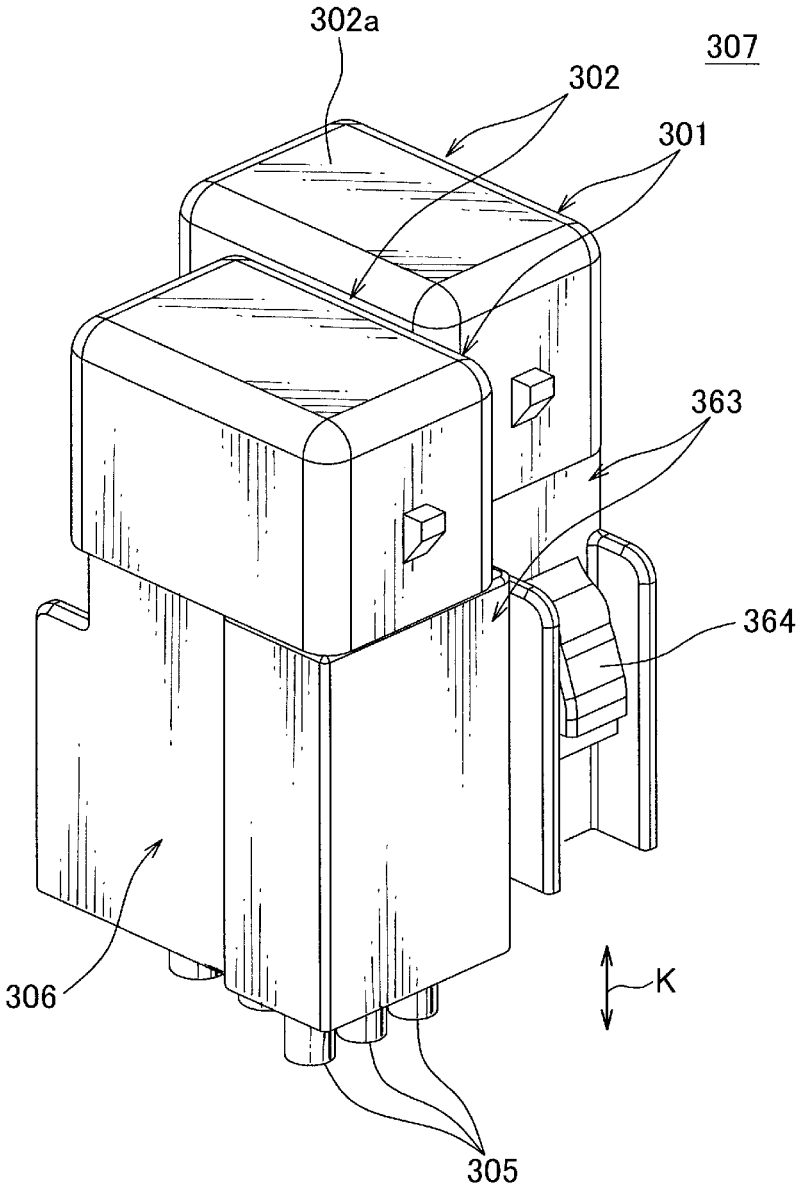
FIG. 22 PRIOR ART
FIG. 22 shows a perspective view of a connection structure of the relays of FIG. 21 with the terminal fittings.
Figure 23:
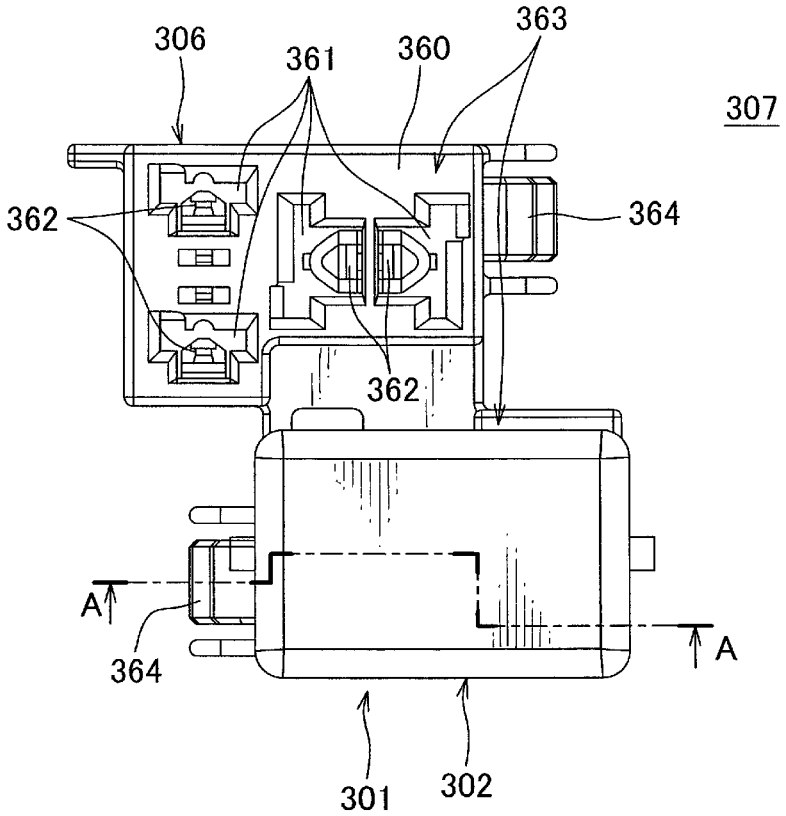
FIG. 23 PRIOR ART
FIG. 23 shows a plan view of the connection structure of the relays with the terminal fittings shown in FIG. 22.
Figure 24:
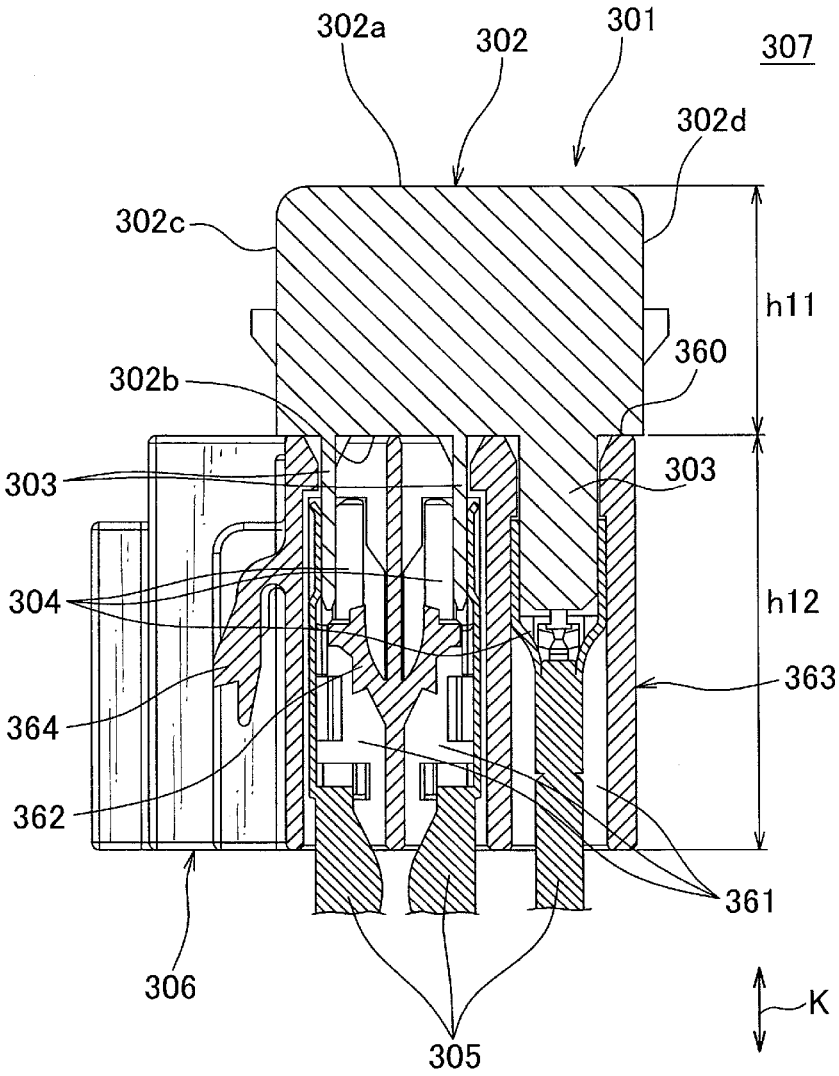
FIG. 24 PRIOR ART
FIG. 24 shows a cross-sectional view taken along the line A-A in FIG. 23.

The "connection structure 207 of the electronic components and the terminal fittings" shown in FIG. 20 includes the single relay 1H shown in FIGS. 12-14, a holding member 206 that has a single relay-receiving portion 63, and a plurality of terminal fittings 104 (see FIGS. 16 and 17).

Although each of the relays 1A-1H of the above-described first to eighth embodiments has four terminals 3, 103, the present invention is not limited to such configuration. For example, the relay may have five terminals 3, 103.

It should be noted that the above-described embodiments are mere typical examples of the present invention, and the present invention is not limited to such embodiments. Various changes and modifications may be made to the illustrated embodiments without departing from the spirit and scope of the present invention (without changing the subject matter of the present invention).

REFERENCE NUMERALS AND SYMBOLS

1A-1H: Relays (electronic components)
2: Relay main body (component main body)
2*c*-2*f*: Lateral faces
3, 103: Terminals
4, 104: Terminal fittings
6, 106, 206: Holding member
7, 107, 207: Connection structure of the electronic components and the terminal fittings

The invention claimed is:

1. An electronic component comprising:

a component main body of which an outer shape is a rectangular parallelepiped; and a plurality of terminals configured to fit in terminal fittings, with front end portions of the plurality of terminals extending parallel along at least one of lateral faces of the component main body, and with each said front end portion of each said terminal not extending beyond the associated one of the lateral faces of the component main body when viewed in a direction perpendicular to the associated one of the lateral faces, wherein the plurality of terminals protrudes from the at least one of the lateral faces which is parallel to a fitting direction of the terminals of the component main body into the terminal fittings, and bends perpendicularly, and wherein the plurality of terminals protrudes from the at least one of lateral faces, lining and being shifted to each other along a direction engaging the plurality of terminals and the terminal fittings.

2. The electronic component according to claim 1 further including a resin member configured to hold the plurality of terminals and be assembled with the component main body, wherein the plurality of terminals bends perpendicularly in contact with the resin member or bends perpendicularly in the resin member.

3. A connection structure of an electronic component and terminal fittings, comprising:

an electronic component according to claim 1;

a plurality of terminal fittings configured to receive and engage with a plurality of terminals of the electronic component; and a holding member configured to house the electronic component and the plurality of terminal fittings.

4. An electrical junction box comprising:

an electronic component according to claim 1;

a plurality of terminal fittings configured to receive and engage with a plurality of terminals of the electronic component; and a holding member configured to house the electronic component and the plurality of terminal fittings.

* * * * *